US007096675B2

(12) United States Patent
Jönsson et al.

(10) Patent No.: US 7,096,675 B2
(45) Date of Patent: Aug. 29, 2006

(54) DEVICE FOR A COMBUSTION CHAMBER IN A GAS TURBINE FOR CONTROLLING THE INTAKE OF GAS TO A COMBUSTION ZONE

(75) Inventors: Bertil Jönsson, Bjärred (SE); Patrik Johansson, Trollhättan (SE)

(73) Assignee: Volvo Aero Corporation, Trollhättan (SE)

( * ) Notice: Subject to any disclaimer, the term of this patent is extended or adjusted under 35 U.S.C. 154(b) by 0 days.

(21) Appl. No.: 10/709,661

(22) Filed: May 20, 2004

(65) Prior Publication Data

US 2005/0144929 A1 Jul. 7, 2005

Related U.S. Application Data

(63) Continuation of application No. PCT/SE02/01854, filed on Oct. 10, 2002.

(30) Foreign Application Priority Data

Nov. 20, 2001 (SE) ..... 0103860

(51) Int. Cl.
*F02C 9/00* (2006.01)

(52) U.S. Cl. ..... 60/794; 60/796

(58) Field of Classification Search ..... 60/785, 60/794, 795, 796, 798, 752, 753, 722, 797, 60/39.23

See application file for complete search history.

(56) References Cited

U.S. PATENT DOCUMENTS 2,458,066 A * 1/1949 Farkas et al. ..... 432/223
3,744,242 A * 7/1973 Stettler et al. ..... 60/39.23
3,765,171 A * 10/1973 Hagen et al. ..... 60/39.23
3,859,787 A * 1/1975 Anderson et al. ..... 60/737
3,930,368 A * 1/1976 Anderson et al. ..... 60/39.23
3,930,369 A 1/1976 Verdouw
3,938,324 A * 2/1976 Hammond et al. ..... 60/737
3,958,413 A 5/1976 Cornelius et al.
4,050,240 A * 9/1977 Vaught ..... 60/39.23
4,085,579 A * 4/1978 Holzapfel et al. ..... 60/774
4,263,780 A * 4/1981 Stettler ..... 60/39.23
4,532,762 A * 8/1985 Mongia et al. ..... 60/39.23
4,785,624 A * 11/1988 Smith et al. ..... 60/806
4,944,149 A 7/1990 Kuwata
5,557,920 A * 9/1996 Kain ..... 60/39.23
5,636,510 A * 6/1997 Beer et al. ..... 60/39.23

FOREIGN PATENT DOCUMENTS

JP 4244512 A 9/1992
JP 11248158 A 9/1999

* cited by examiner

*Primary Examiner*—William H. Rodriguez
(74) *Attorney, Agent, or Firm*—Novak Druce & Quigg, LLP

(57) ABSTRACT

A device for a combustion chamber of a gas turbine for controlling the intake of gas into the combustion zone of the combustion chamber. The device includes a control element that is arranged outside the combustion chamber. This control element has a first covering for at least a first inlet to the combustion zone and is displaceable in relation to the combustion chamber. There is also a support for the control element that is connected to the cover. The cover is displaceable relative to the combustion chamber and a support (16) for the control element (12, 12') is connected to the cover. The support (16) is accommodated in a structure (4) at a rear of the combustion chamber.

27 Claims, 5 Drawing Sheets

DEVICE FOR A COMBUSTION CHAMBER IN A GAS TURBINE FOR CONTROLLING THE INTAKE OF GAS TO A COMBUSTION ZONE

CROSS-REFERENCE TO RELATED APPLICATIONS

The present application is a continuation patent application of International Application No. PCT/SE02/01854 filed 10 Oct. 2002 which was published in English pursuant to Article 21 (2) of the Patent Cooperation Treaty, and which claims priority to Swedish Application No. 0103860-3 filed 20 Nov. 2001. Both applications are expressly incorporated herein by reference in their entireties.

TECHNICAL FIELD

The present invention relates to a device for a combustion chamber of a gas turbine for controlling the intake of gas into the combustion zone of the combustion chamber.

BACKGROUND ART

The present invention relates to a device for a combustion chamber of a gas turbine for controlling the intake of gas into the combustion zone of the combustion chamber. The device comprises (includes, but is not limited to) a control element that is arranged outside the combustion chamber. This control element has a first means of covering at least a first inlet to the combustion zone and is displaceable in relation to the combustion chamber. There is also a means of supporting the control element connected to the cover means.

The term gas turbine relates to a unit which comprises at least one turbine and a compressor that is driven thereby, together with a combustion chamber. Gas turbines are used, for example, as engines for vehicles and aircraft, as prime movers for ships and in electricity-generating power stations.

The gas delivered to the combustion chamber by way of the inlet is usually air, but other gases are also conceivable.

One or more fuel distributors or fuel injectors are arranged in the combustion chamber. The term combustion zone relates to a section in proximity to, and at least substantially in front of the fuel distributor (s) in the longitudinal direction of the combustion chamber. The combustion zone is in turn usually divided up into a primary zone and a dilution zone in the direction away from the fuel distributor.

In order to be able to bring about combustion with low emissions, it is desirable to have the facility for controlling the temperature in the primary zone of the combustion chamber so that it lies within a certain range. This is achieved by using various types of control devices to control the air flow while it is being delivered to the primary zone and/or the dilution zone.

U.S. Pat. No. 4,944,149 describes a device for a combustion chamber for controlling the air intake to the dilution zone of the combustion chamber for the purpose of reducing NOx emissions. The device comprises a rotatable ring, which extends around the combustion chamber in the intended dilution zone thereof. The ring has a plurality of through-openings and the combustion chamber wall has correspondingly shaped openings. By bringing the ring openings over the openings in the combustion chamber wall, ducts are formed for the air from the outside to the inside of the combustion chamber.

A temperature sensor is provided for controlling the rotation of the ring. Due to the very high temperature around the combustion chamber, the constituent parts of the device are subject to great stress, which means that the device has a relatively short service life.

DISCLOSURE OF INVENTION

An object of the invention is to provide a device for controlling the intake of air to a combustion chamber of a gas turbine which creates the prerequisites for greater operating reliability than current state of the art. It is further intended to provide a device having an increased service life.

This object is achieved in that the means of support are accommodated in a structure at the rear of the combustion chamber. Such a construction means that the control element can be accommodated in a relatively cool part of the gas turbine.

According to a preferred embodiment of the invention, the structure in which the means of support is accommodated forms part of the combustion chamber cover. When the gas turbine is in operation, the combustion chamber cover has a considerably lower temperature than the wall of the combustion chamber or the flame tube. The temperature of the flame tube wall is usually five to ten times higher than the temperature of the combustion chamber cover.

According to another preferred embodiment of the invention, the means of support is accommodated in the structure at least largely concentrically in relation to the center line of the combustion chamber. This configuration enables simple and reliable control of the control element.

According to another preferred embodiment of the invention, the means of support is accommodated in the structure radially outside a pilot distributor to the combustion chamber. The pilot distributor is usually arranged so that it extends forwards from the combustion chamber cover into the combustion chamber, along a center line through the combustion chamber. The pilot distributor is therefore arranged in an opening through the combustion chamber cover in an extension of the combustion chamber center line and the opening is therefore suitable for receiving the means of support.

According to another preferred embodiment of the invention, the first cover means has at least one recess that extends at least largely (predominantly) radially through the wall thereof. This enables simple and reliable construction of the control unit. The recess in the cover means is preferably designed, together with the first inlet to the combustion chamber, to form a continuous duct for the gas from a position outside the combustion chamber to the inside of the combustion chamber.

According to a further embodiment, which is a development (variation) of the preceding embodiment, the first cover means comprises at least two sets of the recesses, and a first set of the sets of recesses is arranged at a distance from the second set of recesses in the longitudinal direction of the combustion chamber. This enables a control of the air intake to two sets of so-called swirls in the combustion chamber, which are arranged at a distance from one another in the longitudinal direction of the combustion chamber. These swirls are a type of vortex generator for the air and are formed by a plurality of inclined vanes.

Further preferred embodiments of the invention and advantages thereof are set out in the following description and the patent claims.

BRIEF DESCRIPTION OF THE DRAWINGS

The invention will be described in more detail below with reference to the embodiments shown on the accompanying drawings, and in which.

MODE FOR THE INVENTION

Figure 1:
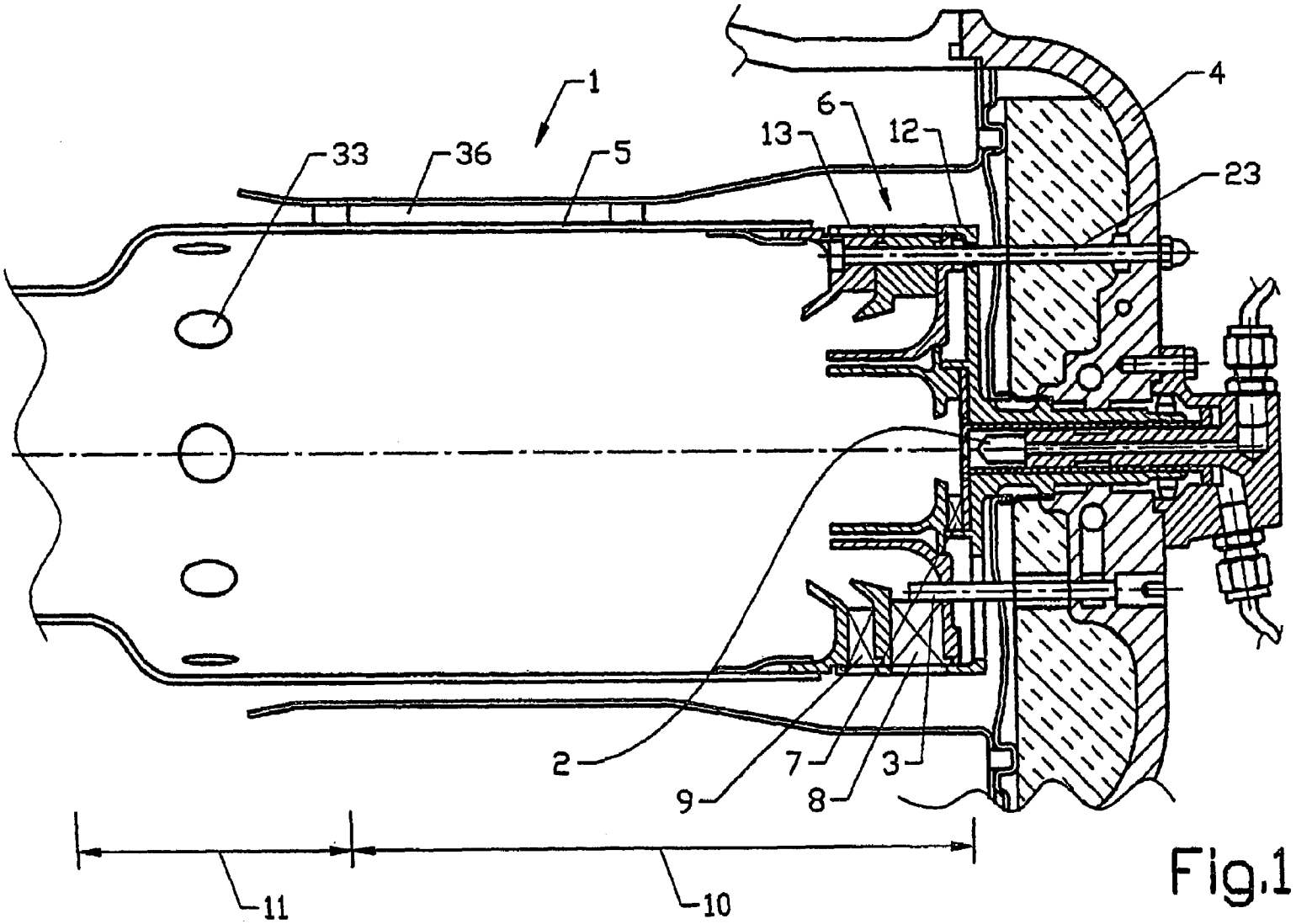
FIG. 1 is a partially cut-away side view of a combustion chamber of a gas turbine depicting a control element according to a first embodiment.

FIG. 1 shows a partially cut away side view of a combustion chamber 1. The illustrated combustion chamber represents a so-called low-emission combustion chamber. The combustion chamber comprises a pilot distributor 2, which is arranged centrally, and a plurality of, for example five, main distributors 3 arranged around the pilot distributor 2. The inside of the combustion chamber 1 is defined by a combustion chamber cover 4, a flame tube 5 and a section 6 arranged between the combustion chamber cover 4 and the flame tube 5 for the inlet of air to the inside of the combustion chamber 1.

The pilot distributor 2 and the main distributors 3 are arranged in the combustion chamber cover 4 and open out into the inside of the combustion chamber 1. Three so- called swirls 7–9 are arranged in the air inlet section 6. These swirls 7–9 are a type of vortex generator for the inlet air and are formed by a plurality of inclined vanes arranged in an annular shape. The swirls 7–9 are intended to force the inlet air to rotate, which means that when it enters the inside of the combustion chamber it is impelled radially outwards. The hot combustion gases thereby recirculate towards the center and are responsible for continuous ignition (reignition) of the fuel.

The air inlet section 6 more specifically comprises a primary swirl 7, a secondary swirl 8 and a tertiary swirl 9. The primary swirl 7 is arranged centrally for guiding the air to or around the pilot distributor 2.

The secondary swirl 8 is arranged around the main distributors 3 for guiding the air to or around the latter. The tertiary swirl 9 is arranged in front of the secondary swirl 8 in the longitudinal direction of the combustion chamber 1.

The fuel to be used is in liquid form. Low emissions can be achieved when the fuel is burned in gaseous form; higher emissions occurring when the fuel is burned in droplet form. The emissions are made up, for example, of CO, NOx and unburned HC.

The main distributors 3 are used in normal operation and are designed for combustion of the fuel in vaporized form. The pilot distributor 2 is designed to heat up the combustion chamber 1 when starting up a cold engine so that it is then possible to produce a working flame with the main distributors 3. The fuel from the pilot distributor 2, on the other hand, is burned in liquid form, in the form of droplets.

The combustion zone of the combustion chamber 1 is usually divided into primary zone 10 and dilution zone 11 in the direction away from the fuel distributors.

A control element 12 (see also FIG. 3), is arranged outside the combustion chamber 1 and interacts with the inlets to the swirls 7–9. An object of this configuration is to control the temperature inside the combustion chamber. The control element 12 is more specifically designed to guide the air flow as it is being delivered to the primary zone and/or the dilution zone. The air flows in a space 36, or a duct, which is situated radially outside the combustion chamber 1. By means of the control element 12, the air can be guided to the inlet to the swirls 7–9 and/or to a number of dilution holes 33 downstream.

Figure 3:
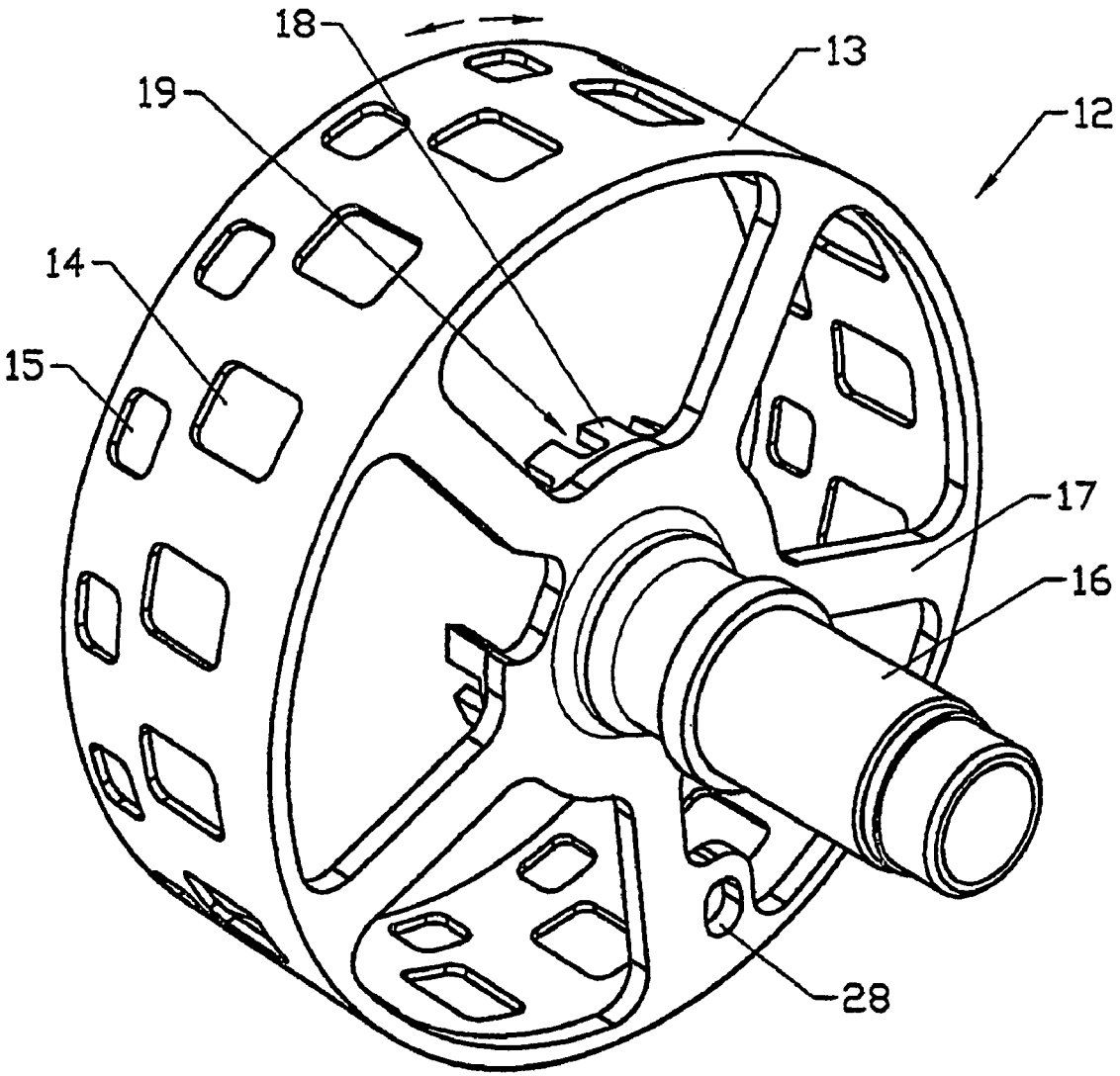
FIG. 3 is a perspective view of the control element.

The control element 12 comprises a first means 13 for covering at least a first inlet to the combustion zone (see also FIG. 3). The first cover means 13 is in the shape of a ring or sleeve that extends around the first inlets to the secondary and the tertiary swirls 8, 9. The ring 13 is provided with two sets of recesses 14, 15. Each of the sets 14, 15 comprises a plurality of recesses in the form of through-openings which are arranged at a distance from one another in the circumferential direction of the ring. A first set of recesses 14 is arranged at a distance from the second set of recesses 15 in the axial direction of the ring.

The control element 12 is designed to be set to two limit positions corresponding to an inlet fully open and an inlet fully closed configurations, and also being continuously adjustable into positions between the two limit positions for partial closure of the inlets.

Figure 2:
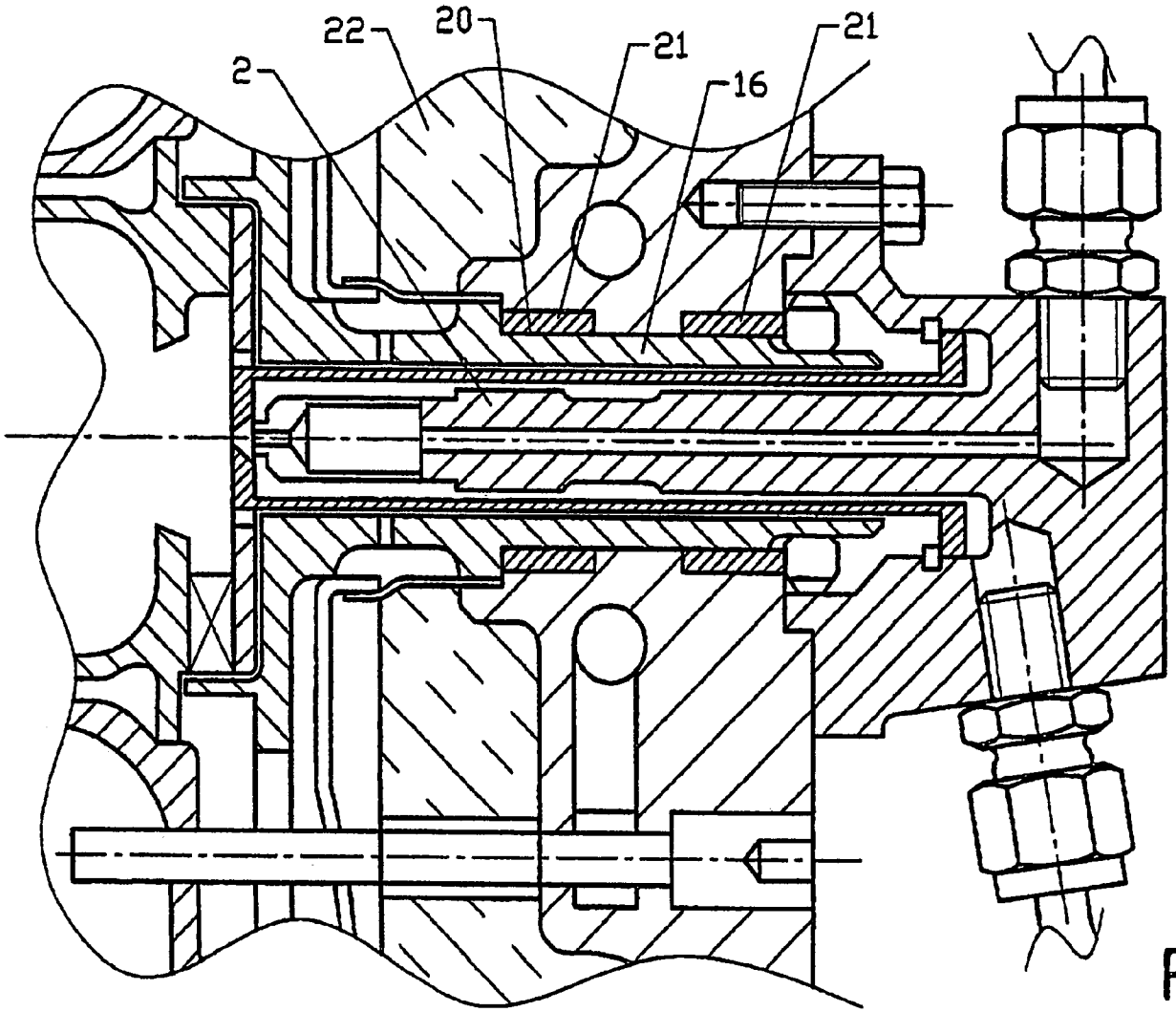
FIG. 2 is an enlarged detail side view of the control element support on the combustion chamber cover.

The control element 12 further comprises a means 16, connected to the ring 13, for supporting the control element (see also FIGS. 2 and 3). The means of support 16 has a circular cross-sectional shape; and more specifically, the shape of a tube, or a sleeve. The center line of the circular means of support 16 and the center line of the annular, first cover means 13 coincide. The means of support 16 is further offset in an axial direction in relation to the first cover means 13. The circular means of support 16 has a smaller outside diameter than the annular, first cover means 13 and they are connected to one another by a spoke structure 17. The spoke structure 17 extends in a plane at right angles to the center line of the control, element 12. The air to the primary swirl 7 is intended to flow in through the openings between the spokes of the spoke structure.

The control element 12 further comprises an annular section 18 having a smaller diameter than the ring 13 (see also FIG. 3). The annular section 18 is arranged radially inside the ring 13. The annular section 18 is provided with a third set of recesses 19 and is intended for controlling the inlets to the primary swirl 7.

The means of support 16 is accommodated in the combustion chamber cover 4, which is arranged at the rear of the combustion zone of the combustion chamber 1 (see FIG. 2). This means that the support means is accommodated in a relatively cool part of the gas turbine. In a normal operating situation, the temperature can reach 150 degrees in the combustion chamber cover and 800 degrees in the combustion chamber wall near the swirls 7–9. The control element 12 is more specifically accommodated radially outside the pilot distributor 2. The means of support 16 for the control element 12 extends around the pilot distributor 2 and is supported against the combustion chamber cover 4 by its radially outer surface 20. The support comprises slide or roller bearings 21. That is to say, there is a gap between the means of support 16 and the pilot distributor 2.

The combustion chamber cover 4 contains a section 22 of insulating material. The fact that the insulating section 22 is arranged between the bearing 21 and the outlets of the fuel distributors 2, 3 means that the area of the support is relatively cool.

The swirls 7–9 are fixed to the combustion chamber cover by a fastener 23 in the form of a bolt (see FIG. 1).

The fact that the control element 12 and the swirls 7–9 are respectively supported in, and connected to the same structure (the combustion chamber cover) means that they can be centered in relation to one another with great accuracy, and any thermal expansion problems can be minimized. This improves the facilities (capabilities) for highly accurate control.

Figure 4:
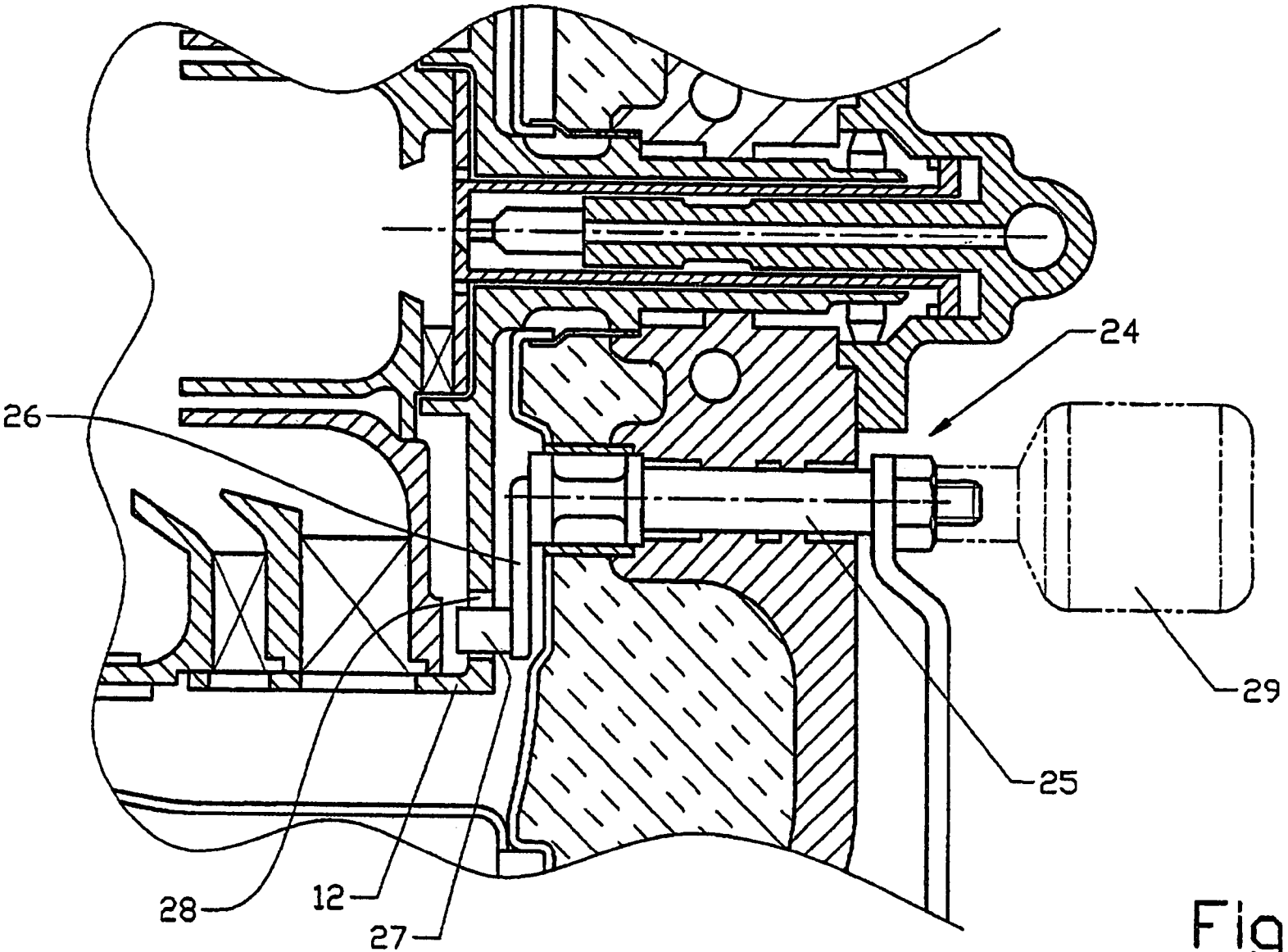
FIG. 4 is side view of the control element, and in particular, the control unit mechanism.

A control mechanism 24 is shown in FIG. 4. The control mechanism 24 comprises a first rotatable arm 25 that extends through the combustion chamber cover 4. A second arm 26 is fixed to the first arm 25 at an inner end thereof and extends at right angles therefrom. The second arm 26 has a pin 27 at its free end. The pin 27 is arranged in a groove 28 (see also FIG. 3) in the control element 12, and more specifically, in the spoke structure 17. The control mechanism further comprises an adjusting device 29 coupled to the first arm 25 on a rear side of the combustion chamber cover 4 relative to the combustion chamber 1. The adjusting device 29 is designed for turning the arm 25 so that the control element 12 is thereby also turned. Alternatively the turning function can also be achieved by means of a linkage system. The adjusting device 29 in this instance comprises an electric motor, but may also consist of a hydraulic or pneumatic adjusting device.

Figure 5:
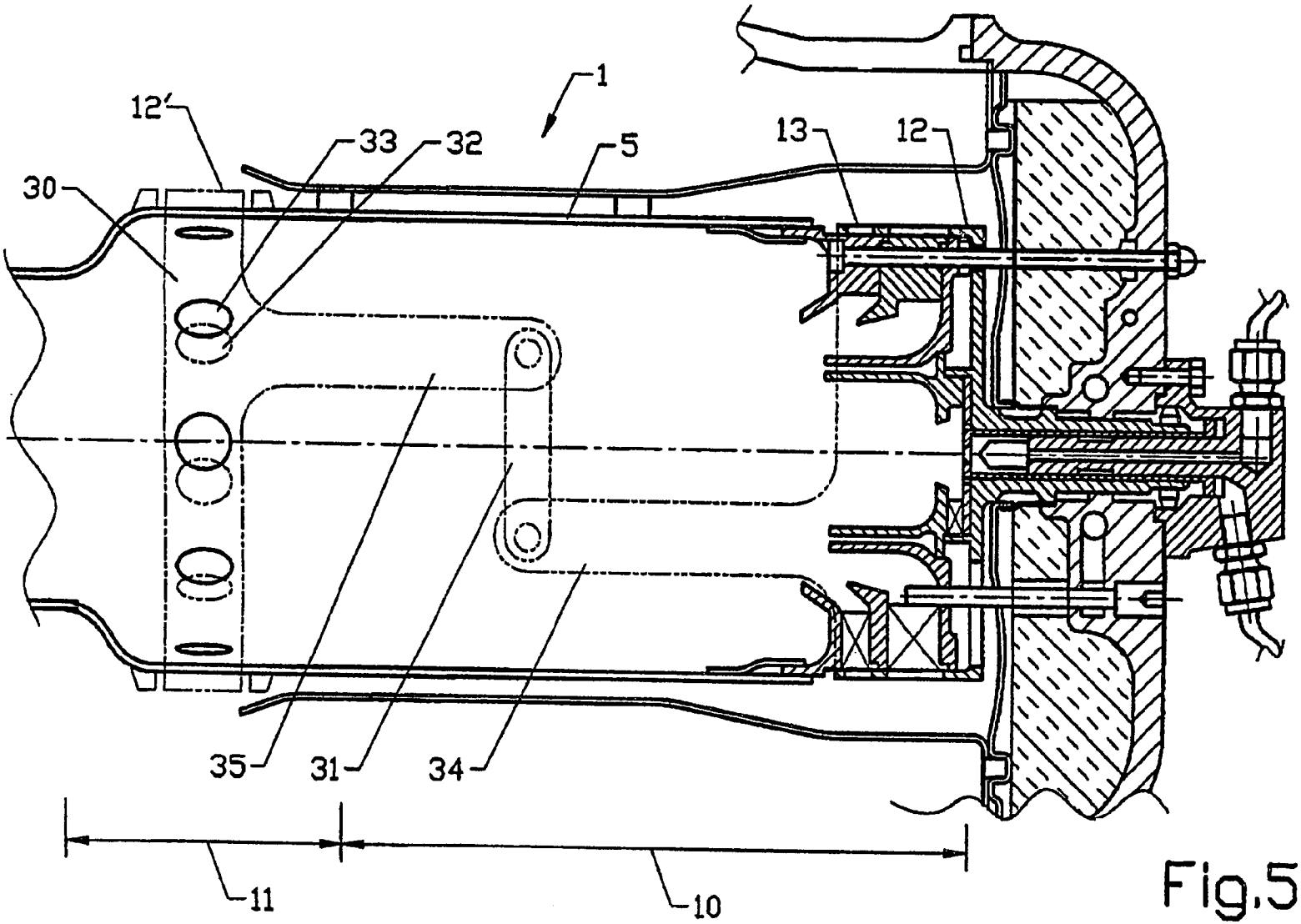
FIG. 5 is a schematic representation of a second embodiment of the control element.

FIG. 5 shows a second embodiment of the control element 12' which is a variant of the first embodiment. The control element 12' according to the second embodiment differs from the control element 12 of the first embodiment in that the control element 12' comprises a further, second, cover means 30 in the form of a ring or sleeve signified in the figures using dashed marks. The second cover means 30 is arranged around the flame tube 5 of the combustion chamber 1 at a distance from the first cover means 13 in the longitudinal direction of the combustion chamber 1, and more specifically, in the dilution zone 11 of the combustion chamber.

The annular cover means 30 has a set of through-openings 32, which are arranged at a distance from one another in the circumferential direction of the ring and are intended to interact with a number of other inlets 33 to the combustion chamber in the form of so-called dilution holes.

The ring 30 is connected to the ring 13 by at least one link 31. Each of the rings 13, 30 has at least one extended section 34, 35, which extend towards one another. These extended sections 34, 35 are connected to one another by the linkage 31.

The second embodiment of the control element is particularly advantageous if it is intended to redistribute the air between primary and dilution zone with a slight variation in the overall pressure gradient. The openings in the rings 13, 30 are offset in relation to their corresponding inlet in such a way that when control adjustment occurs, the swirl inlets to the swirls 7–9 are exposed, while the dilution holes 33 are covered over, and vice versa. The fact that the ring 30 is connected by the linkage 31 to the ring 13 furthermore means that the lower part of the flame tube 5 is permitted to move somewhat away from the center without the parts impinging on one another.

The invention must not be regarded as being limited to the exemplary embodiments described above, a number of further variants and modifications are feasible without departing from the scope of associated patent claims.

For example, the means of support 16 and the first cover means 13 comprise a ring or tube of continuous circumference, but the scope of the invention also encompasses those of broken circumference. Nor are any holes necessary in an axial direction for the means of support 16, which can also feasibly be formed by a solid shaft.

The control element 12 can also be arranged so that it is displaceable in an axial direction instead of being rotatable about the center line of the combustion chamber.

The spoke structure 17 of the control element 12 must only be regarded as one example and may be replaced, for example, by some other type of wall structure or framework having through-holes or openings.

Furthermore, the low-emission combustion chamber described above must only be regarded as an example of an application and in no way limits the scope of the invention.

The invention claimed is:

1. A device for controlling the intake of gas into a combustion zone (10, 11) of the combustion chamber (1) of a gas turbine having a combustion chamber cover (4), said device comprising:

a control element (12, 12') arranged outside the combustion chamber (1);

said control element (12, 12') further comprising a first cover means (13) for covering at least a first inlet to the combustion zone, said First cover means being displaceable relative to the combustion chamber (1); and a support means (16) connected to the first cover means (13) for providing support to the control element (12, 12'), said support means (16) being accommodated interiorly within the combustion chamber cover (4) rearwardly located with respect to the combustion chamber (1) and said support means (16) being substantially concentrically oriented relative to a centerline of the combustion chamber (1).

2. The device as recited in claim 1, wherein said control element (12, 12') is exclusively supported on said support means (16) in an operating configuration, without contact with the combustion chamber (1).

3. The device as recited in claim 1, wherein the structure (4) within which the support means (16) is accommodated is thermally insulated from the combustion chamber (1).

4. The device as recited in claim 1, wherein the support means (16) extends through the combustion chamber cover (4).

5. The device as recited in claim 1, wherein the support means (16), when accommodated in combustion chamber cover (4), is radially oriented outside a pilot distributor (2) to the combustion chamber.

6. The device as recited in claim 5, wherein the support means (16) extends around the pilot distributor (2) and the support means (16) is supported against the structure (4) at an outer surface (20) of the support means (16).

7. The device as recited in claim 1, wherein the support means (16) has a circular cross-sectional shape.

8. The device as recited in claim 1, wherein the first cover means (13) has at least one recess (14, 15) extending through a wall (13) thereof in a substantially radial direction of the control element (12, 12').

9. The device as recited in claim 8, wherein said at least one recess (14, 15) in the first cover means (13) and first inlet to the combustion chamber, when in registration with one another, are configured to form a through-duct for gas passing from outside the combustion chamber to inside the combustion chamber.

10. The device as recited in claim 9, wherein the first cover means (13) further comprises at least two sets of recesses, a first set of recesses being arranged at a distance from a second set of recesses with respect to a longitudinal direction of the combustion chamber.

11. The device as recited in claim 8, wherein the control element (12, 12') comprises an annular cover section (18) configured to cover at least one inlet to the combustion zone of the combustion chamber (1) different from the first inlet, the cover section (18) being arranged at a lesser distance from a centerline of the control element (12, 12') than the first cover means (13), and the annular cover section (18) having at least one recess (19) therein.

12. The device as recited in claim 8, wherein the wall of the first cover means (13) is ring-shaped and said at least one recess (14, 15) extends therethrough.

13. The device as recited in claim 1, wherein the first cover means (13) is rotatable relative to the combustion chamber (1).

14. The device as recited in claim 1, wherein the support means (16) and the first cover means (13) are integral with one another.

15. The device as recited in claim 1, wherein the control element (12, 12') is rotatable relative to the combustion chamber cover (4) within which the support means (16) is accommodated.

16. The device as recited in claim 1, wherein the first cover means (13) is arranged at a greater radial distance from a central axis through the control element (12, 12') than the support means (16).

17. The device as recited in claim 1, wherein the first inlet extends through a combustion chamber wall and forms a gas inlet into at least one swirl (8, 9) arranged in the combustion chamber (1).

18. The device as recited in claim 1, wherein the control element (12, 12') further comprises a second cover means (30) configured to cover at least a second inlet (33) to the combustion zone, the at least one second inlet being arranged at a distance from the at least one first inlet in a longitudinal direction of the combustion chamber (1).

19. The device as recited in claim 18, wherein the second cover means (30) has at least one recess (32) that extends in a substantially radial direction through a wall thereof.

20. The device as recited in claim 19, wherein said at least one recess (32) in the second cover means (30) and the second inlet (33) to the combustion chamber, when in registration with one another, are configured to form a through-duct for gas passing from outside the combustion chamber to inside the combustion chamber.

21. The device as recited in claim 19, wherein the second cover means (30) is in the shape of a ring with said at least one recess (32) extending through a wall thereof.

22. The device as recited in claim 18, wherein the second cover means (30) is rotatable relative to the combustion chamber (1).

23. The device as recited in claim 22, wherein the second cover means (30) is connected to the first cover means (13) by at least one arm (31, 34. 35).

24. A device for controlling the intake of gas into a combustion zone (10, 11) of the combustion chamber (1) of a gas turbine, said device comprising:

a control element (12, 12') arranged outside the combustion chamber (1);

said control element (12, 12') further comprising a first cover means (13) for covering at least a first inlet to the combustion zone, said first cover means being displaceable relative to the combustion chamber (1); and a support means (16) connected to the first cover means (13) for providing support to the control element (12, 12'), said support means (16) being accommodated interiorly within a structure (4) rearwardly located with respect to the combustion chamber (1) and said support means (16) being substantially concentrically oriented relative to a centerline of the combustion chamber (1) and wherein the structure (4) within which the support means (16) is accommodated is thermally insulated from the combustion chamber (1).

25. A device for controlling the intake of gas into a combustion zone (10, 11) of the combustion chamber (1) of a gas turbine, said device comprising:

a control element (12, 12') arranged outside the combustion chamber (1);

said control element (12, 12') further comprising a first cover means (13) for covering at least a first inlet to the combustion zone, said first cover means being displaceable relative to the combustion chamber (1); and a support means (16) connected to the first cover means (13) for providing support to the control element (12, 12'), said support means (16) being accommodated interiorly within a structure (4) rearwardly located with respect to the combustion chamber (1) and said support means (16) being substantially concentrically oriented relative to a centerline of the combustion chamber (1) and wherein the support means (16), when accommodated in the structure (4), is radially oriented outside a pilot distributor (2) to the combustion chamber, extends around the pilot distributor (2), and is supported against the structure (4) at an outer surface (20) of the support means (16).

26. A device for controlling the intake of gas into a combustion zone (10, 11) of the combustion chamber (1) of a gas turbine, said device comprising:

a control element (12, 12') arranged outside the combustion chamber (1);

said control element (12, 12') further comprising a first cover means (13) for covering at least a first inlet to the combustion zone, said first cover means being displaceable relative to the combustion chamber (1) and comprising at least two sets of recesses, a first set of recesses being arranged at a distance from a second set of recesses with respect to a longitudinal direction of the combustion chamber; and a support means (16) connected to the first cover means (13) for providing support to the control element (12, 12'), said support means (16) being accommodated interiorly within a structure (4) rearwardly located with respect to the combustion chamber (1) and said support means (16) being substantially concentrically oriented relative to a centerline of the combustion chamber (1) and wherein the first cover means (13) has at least one recess (14, 15) extending through a wall (13) thereof in a substantially radial direction of the control element (12, 12'), such that when in registration with the first inlet to the combustion chamber, are configured to form a through-duct for gas passing from outside the combustion chamber to inside the combustion chamber.

27. A device for controlling the intake of gas into a combustion zone (10, 11) of the combustion chamber (1) of a gas turbine having a combustion chamber cover (4), said device comprising:

a control element (12, 12') arranged outside the combustion chamber (1);

said control element (12, 12') further comprising a first cover means (13) for covering at least a first inlet to the combustion zone, said first cover means being displaceable relative to the combustion chamber (1); and a support means (16) connected to the first cover means (13) for providing support to the control element (12, 12'), said support means (16) being accommodated interiorly within a structure (4) rearwardly located with respect to the combustion chamber (1) and said support means (16) being substantially concentrically oriented relative to a centerline of the combustion chamber (1), wherein the first cover means (13) has at least one recess (14, 15) extending through a wall (13) thereof in a substantially radial direction of the control element (12, 12') and wherein the control element (12, 12') comprises an annular cover section (18) configured to cover at least one inlet to the combustion zone of the combustion chamber (1) different from the first inlet, the cover section (18) being arranged at a lesser distance from a centerline of the control element (12, 12') than the first cover means (13), and the annular cover section (18) having at least one recess (19) therein.

* * * * *